US010421298B2

(12) United States Patent
Kitahara et al.

(10) Patent No.: US 10,421,298 B2
(45) Date of Patent: Sep. 24, 2019

(54) PRINTER AND CONTROL METHOD OF A PRINTER

(71) Applicant: SEIKO EPSON CORPORATION, Tokyo (JP)

(72) Inventors: Masashi Kitahara, Minamiminowa (JP); Atsushi Imamura, Shiojiri (JP); Shinji Kawakami, Azumino (JP); Naoki Hori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/975,636

(22) Filed: May 9, 2018

(65) Prior Publication Data

US 2018/0326759 A1 Nov. 15, 2018

(30) Foreign Application Priority Data

May 15, 2017 (JP) ..... 2017-096411

(51) Int. Cl.

*B41J 11/46* (2006.01)
*B41J 11/00* (2006.01)
*B41J 13/00* (2006.01)

(52) U.S. Cl.

CPC ..... *B41J 11/46* (2013.01); *B41J 11/009* (2013.01); *B41J 11/0095* (2013.01); *B41J 13/0027* (2013.01)

(58) Field of Classification Search

CPC ..... B41J 2/17596; B41J 2/175; B41J 2/17509
See application file for complete search history.

(56) References Cited

U.S. PATENT DOCUMENTS

| | | | |
|---|---|---|---|
| 5,754,195 | A | 5/1998 | Yokono |
| 6,036,298 | A | 3/2000 | Walker |
| 6,322,192 | B1 | 11/2001 | Walker |
| 6,325,505 | B1 | 12/2001 | Walker |
| 6,386,669 | B1 | 5/2002 | Scofield et al. |
| 6,425,650 | B1 | 7/2002 | Walker et al. |
| 6,561,643 | B1 | 5/2003 | Walker et al. |
| 6,585,341 | B1 | 7/2003 | Walker et al. |

(Continued)

FOREIGN PATENT DOCUMENTS

| | | | |
|---|---|---|---|
| CN | 1372512 | A | 10/2002 |
| JP | 2004-326658 | A | 11/2004 |

(Continued)

OTHER PUBLICATIONS

European Search Report issued in Application No. 18172144 dated Oct. 18, 2018.

*Primary Examiner* — Lamson D Nguyen
(74) *Attorney, Agent, or Firm* — Workman Nydegger

(57) ABSTRACT

Technology enabling accurately detected marks on a print medium according to the type of print medium is provided. A printer 1 has a media type identifier 110 that determines the type of medium; a mark sensor 76 that projects light and detects a mark on the medium; and an emittance controller 111 that sets the emittance level of the light the mark sensor 76 projects. The printer 1 can change the operating mode according to the type of medium M identified by the media type identifier 110. In the white medium mode, the mark sensor 76 detects a mark MR with the emittance level set to a white medium emittance level. In the non-white medium mode, the mark sensor 76 detects a mark MR with the emittance level set to a non-white medium emittance level, which is higher than the white medium emittance level.

9 Claims, 9 Drawing Sheets

(56) References Cited

U.S. PATENT DOCUMENTS

| | | | |
|---|---|---|---|
| 2002/0130942 | A1 | 9/2002 | Walker et al. |
| 2003/0001939 | A1 | 1/2003 | Scofield et al. |
| 2005/0073544 | A1 | 4/2005 | Scofield et al. |
| 2009/0213165 | A1 | 8/2009 | Burke et al. |
| 2015/0174927 | A1 | 6/2015 | Oba et al. |
| 2015/0339558 | A1 | 11/2015 | Kanai |

FOREIGN PATENT DOCUMENTS

| | | | |
|---|---|---|---|
| JP | 2004-341697 | A | 12/2004 |
| JP | 2015-117123 | A | 6/2015 |

PRINTER AND CONTROL METHOD OF A PRINTER

BACKGROUND

1. Technical Field

The present invention relates to a printer and a control method of a printer.

2. Related Art

Technology for projecting light to detect a specific mark on a print medium (such as label paper) is known from the literature. See, for example, JP-A-2015-209296. JP-A-2015-209296 describes technology having a reflective optical sensor and a transmissive optical sensor, using the reflective optical sensor to detect a mark (black mark) at a specific position in relation to a label and determine the location of the mark, and setting a detection threshold for detecting the edge of a label to an appropriate value based on a detection result from the transmissive optical sensor.

However, this technology for detecting marks on a print medium may also detect marks that reflect a different amount of light. Because JP-A-2015-209296 is based on detecting marks by emitting light at a specific emittance level, that the amount of light reflected by a mark may vary according to the type of recording medium is not considered, and accurately detecting the marks may not be possible depending on the type of recording medium.

SUMMARY

An objective of the present invention is therefore to provide technology enabling detecting marks on a recording medium accurately according to the type of recording medium.

To achieve the foregoing objective, a printing device according to the invention has: a media type identifier configured to identify a type of a print medium; a detection device configured to project light and detect a mark on the print medium; and an emittance controller configured to set an emittance level of light the detection device projects; the printing device changing an operating mode according to the type of print medium identified by the media type identifier to a first mode used to process a print medium having greater reflectance of light than the mark, or a second mode used to process a print medium having less reflectance of light than the mark; the detection device detecting a mark with the emittance level set by the emittance controller to a first level in the first mode, and detecting a mark with the emittance level set by the emittance controller in the second mode to a second level, which is higher than the first level.

Thus comprised, because the emittance controller sets the first level to detect marks when the operating mode corresponding to the type of print medium is the first mode, and sets the second level to detect marks when the operating mode is set to the second mode, light is projected at different emittance levels according to the type of the print medium, and marks on the print medium can be detected accurately according to the type of print medium.

Preferably in a printing device according to another aspect of the invention, the emittance controller, in the second mode, sets the emittance level of the detection device to a third level, and based on a mark the detection device detects with light projected at the third level, sets the emittance level of the detection device to the second level.

Because this configuration sets the second level based on a mark detected with light projected at the third level, being unable to detect marks due to the type of marks on the print medium can be reduced, and marks on a print medium can be accurately detected.

A printing device according to another aspect of the invention preferably also has a threshold controller configured to set a threshold the detection device uses to detect the mark, and the threshold controller, in the second mode, sets the threshold based on the mark the detection device detected by projecting light.

Because this configuration sets the threshold based on a mark detected by projected light, detecting other than marks when light is projected at the first level, second level, or third level can be prevented, and marks on a print medium can be accurately detected.

In a printing device according to another aspect of the invention, the threshold controller sets, as the threshold, a median between an amount of light projected by the detection device that is reflected by the print medium outside the mark, and the amount of light that is reflected by the mark.

By setting as the threshold the median between the amount of light that is reflected by the print medium in an area other than a mark, and the amount of light that is reflected by a mark, this configuration enables accurately detecting edges of the mark, and accurately detecting marks printed on the print medium.

A printing device according to another aspect of the invention preferably also has a reporting device configured to report information; the reporting device reporting information indicating an error when the detection device cannot detect a mark by light projected at the third level.

By reporting information indicating an error when a mark cannot be detected when by light projected at the third level, this configuration enables the user to know that the printing device cannot detect marks on the print medium.

A printing device according to another aspect of the invention preferably also has a conveyance mechanism configured to convey the print medium; and a printing position controller configured to, when the detection device cannot detect a mark with light projected at the third level, project light by the detection device at the third level to the printing surface of the print medium while conveying the print medium by the conveyance mechanism, and determine a position at which to start printing based on an amount of light reflected from the printing surface of the print medium.

Because the position at which to start printing is determined based on an amount of light reflected from the printing surface of the print medium, this configuration can index the print medium even when marks on the print medium cannot be detected.

In a printing device according to another aspect of the invention, the conveyance mechanism, when the detection device projects light at the third level to the printing surface of the print medium, conveys the print medium at a conveyance speed that is slower than the conveyance speed when printing.

When light is projected at the temporary emittance level to the printing surface of the print medium, this configuration conveys the print medium at a conveyance speed that is slower than the conveyance speed when printing. As a result, the printing device can accurately detect change in the light reflected from the printing surface of the print medium, and can accurately index the print medium even when marks on the print medium cannot be detected.

In a printing device according to another aspect of the invention, the emittance controller sets the first level in the first mode based on the detection device projecting light to a part of the print medium other than a mark.

Thus comprised, because in the first mode the first level is set based on projection of light to a part of the print medium other than a mark, the first level can be set quickly without executing a process projecting light at the third level, and the processing load required to set the emittance level can be reduced.

In a printing device according to another aspect of the invention, the detection device projects light to a margin of the print medium, and the media type identifier, based on the amount of light projected to the margin of the print medium that is reflected, determines the type of print medium.

Thus comprised, because the type of print medium is identified based on the amount of projected light that is reflected from the margin of the print medium, the type of print medium can be accurately detected using a margin where nothing is printed.

In a printing device according to another aspect of the invention, the print medium that is processed in the first mode is a print medium that is white, and a print medium that is processed in the second mode is a print medium of a color other than white.

Thus comprised, marks on the print medium can be accurately detected based on whether the print medium is white or the print medium is a color other than white.

Another aspect of the invention is a control method of a printing device including: identifying a type of a print medium; changing an operating mode according to the type of print medium identified to a first mode used to process a print medium having greater reflectance of light than a mark on the print medium, or a second mode used to process a print medium having less reflectance of light than the mark; and in the first mode, detecting a mark with the emittance level of projected light set to a first level, and in the second mode, detecting a mark with the emittance level set to a second level.

Thus comprised, because an emittance controller sets the first level to detect marks when the operating mode corresponding to the type of print medium is the first mode, and the emittance controller sets the second level to detect marks when the operating mode is set to the second mode, light can be projected at different emittance levels according to the type of the print medium, and marks on the print medium can be detected accurately according to the type of print medium.

Other objects and attainments together with a fuller understanding of the invention will become apparent and appreciated by referring to the following description and claims taken in conjunction with the accompanying drawings.

DESCRIPTION OF EMBODIMENTS

Figure 1:
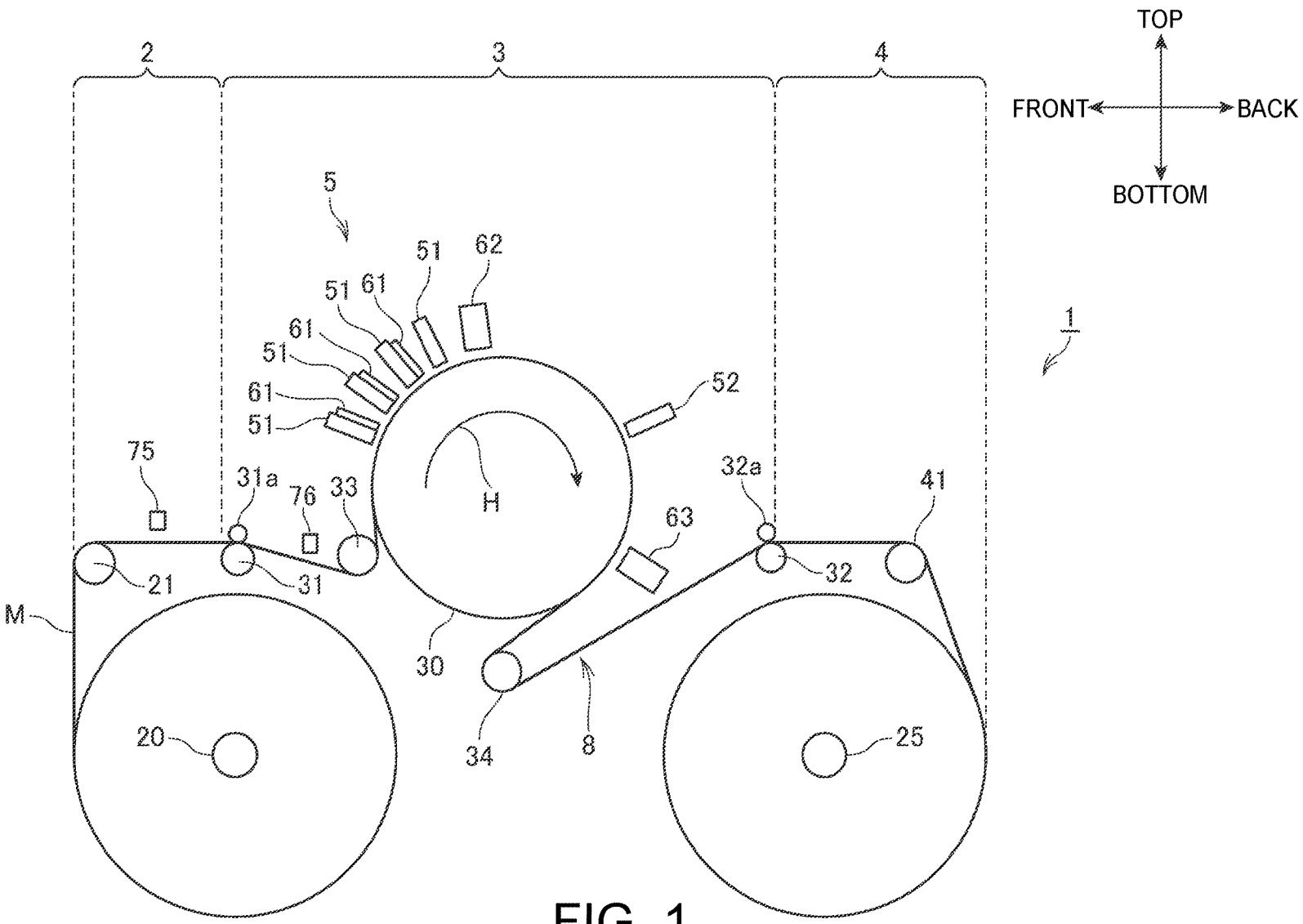
FIG. 1 schematically illustrates the configuration of main parts of a printer.

FIG. 1 schematically illustrates the configuration of main parts of a printer 1 (printing device) according to the invention.

As indicated by the arrows in FIG. 1, the direction to the left in the figure is referred to as forward or the front of the printer 1; the direction to the right in the figure is referred to as reverse or the back; the direction to the top in the figure is referred to as the top or above; and the direction to the bottom in the figure is referred to as the bottom or below.

The printer 1 is a device for printing text, images, or other content on a print medium, communicatively connects to a host computer or other external device not shown in the figures, and prints based on print data received from an external device.

An example of a print medium on which the printer 1 prints text, images, or other content in this embodiment of the invention is a medium M (print medium) that is wound into a roll. Below, the side of the medium M the printer 1 prints on (the side facing the inkjet heads 51 and 52) is referred to as the front or the printing surface, and the side the printer 1 does not print on is referred to as the back.

As shown in FIG. 1, the printer 1 has a media delivery device 2 that delivers the medium M from a delivery spindle 20; a printing mechanism 3 that prints text, images, or other content on the medium M delivered by the media delivery device 2; and a take-up device 4 that rewinds the medium M printed on by the printing mechanism 3 on a take-up spindle 25.

The media delivery device 2 includes the delivery spindle 20 on which one end of the medium M is attached, and a follower roller 21 around which travels the medium M delivered from the delivery spindle 20. The delivery spindle 20 holds the trailing end of the medium M wound thereto so that the printing surface of the medium M faces the outside, or in other words, so that the back side of the medium M faces the follower roller 21.

By the delivery spindle 20 turning clockwise as seen in FIG. 1, the medium M wound onto the delivery spindle 20 is delivered around the follower roller 21 to the printing mechanism 3. The medium M is wound to the delivery spindle 20 through a core (not shown in the figure) that is removably mounted on the delivery spindle 20. When the medium M on the delivery spindle 20 runs out, a new core with rolled medium M wound thereto is mounted on the delivery spindle 20, and the medium M on the delivery spindle 20 can thus be replaced. The delivery spindle 20 is turned by drive power from a motor not shown connected to the delivery spindle 20 through a power transfer mechanism.

The printing mechanism 3 supports the medium M delivered from the media delivery device 2 by a platen drum 30, and prints text, images, or other content on the medium M by the printing unit 5 disposed around the outside circumference of the platen drum 30. The printing unit 5 is described further below.

A front drive roller 31 is disposed on the front side of the platen drum 30, and a back drive roller 32 is disposed on the back side of the platen drum 30. The medium M delivered from the front drive roller 31 to the back drive roller 32 is supported winding around the platen drum 30. The printing mechanism 3 ejects ink from the inkjet heads 51 of the printing unit 5 to the part of the medium M wound around the platen drum 30, and prints text, images, or other content by the ink landing on the medium M.

The front drive roller 31 has numerous minute protrusions formed on the outside surface by thermal spraying, and the medium M delivered from the media delivery device 2 is wound with the back side against the front drive roller 31. As the front drive roller 31 turns clockwise as seen in FIG. 1, the medium M delivered from the media delivery device 2 is conveyed downstream in the conveyance direction H. At the position opposite the front drive roller 31 is disposed a nip roller 31*a* for conveying the medium M in conjunction with the front drive roller 31. The nip roller 31*a* is urged to the front drive roller 31, and contacts the front side of the medium M, holding the medium M between the nip roller 31*a* and the front drive roller 31. As a result, friction between the front drive roller 31 and the medium M is assured, and the printer 1 can reliably convey the medium M by the front drive roller 31.

The platen drum 30 is a cylindrical drum supported freely rotatably by a support mechanism not shown. The medium M conveyed from the front drive roller 31 to the back drive roller 32 is wound with the back side of the medium M against the platen drum 30. The platen drum 30 supports the medium M from the back side while turning in the conveyance direction H driven by friction with the medium M.

The printing mechanism 3 also has a follower roller 33 and a follower roller 34 that turn the medium M at take-off points on opposite sides of the platen drum 30. Follower roller 33 contacts the front side of the medium M between the front drive roller 31 and the platen drum 30, and turns the medium M onto the platen drum 30. The other follower roller 34 also contacts the front side of the medium M between the platen drum 30 and the back drive roller 32, and turns the medium M from the platen drum 30 to the back drive roller 32. By turning the medium M on the upstream side and downstream side of the platen drum 30 in the conveyance direction H, the length of the medium M wound around the platen drum 30 is increased.

The back drive roller 32 has numerous minute protrusions formed on the outside surface by thermal spraying, and the medium M delivered from the platen drum 30 and follower roller 34 is wound with the back side against the back drive roller 32. As the back drive roller 32 turns clockwise as seen in FIG. 1, the medium M is conveyed to the take-up device 4. At the position opposite the back drive roller 32 is disposed a nip roller 32*a* for conveying the medium M in conjunction with the back drive roller 32. The nip roller 32*a* is urged to the back drive roller 32, and contacts the front side of the medium M, holding the medium M between the nip roller 32*a* and the back drive roller 32. As a result, friction between the back drive roller 32 and the medium M is assured, and the printer 1 can reliably convey the medium M by the back drive roller 32.

The medium M conveyed from the front drive roller 31 to the back drive roller 32 is thus supported by the outside surface of the platen drum 30. To print text, images, or other content on the medium M supported by the platen drum 30, the printing mechanism 3 has a plurality of inkjet heads 51 ejecting ink of different colors disposed to the printing unit 5. Each inkjet head 51 is disposed to a position with a specific gap to the surface of the medium M wound onto the platen drum 30, and ejects ink of a corresponding color. The printer 1 prints text, images, or other content on the surface of the medium M by ejecting ink from the inkjet heads 51 to the medium M conveyed in the conveyance direction H.

The plural inkjet heads 51 in this embodiment of the invention are inkjet line heads extending in the direction crosswise to the conveyance direction H of the medium M, and in this example are cyan (C), magenta (M), yellow (Y), and black (K) ink printheads. In this embodiment of the invention, the inks ejected by the inkjet heads 51 are UV (ultraviolet) inks that cure when exposed to ultraviolet light. As a result, the printing unit 5 comprises UV light sources 61 and a UV light source 62 disposed around the outside circumference of the platen drum 30 for curing and fusing the ink to the medium M.

In this embodiment of the invention curing the ink is a two-step process including initial curing and final curing. Initial curing hardens the surface of the ink deposited on the medium M to the extent that the ink does not flow off of or bleed into the medium M. The final curing step completely cures the initially cured ink to the inside by emitting stronger ultraviolet light than used for the initial curing. A UV light source 61 for initial curing is disposed between each of the plural inkjet heads 51, and each UV light source 62 partially cures the UV ink ejected from the corresponding inkjet head 51. A UV light source 62 for final curing is disposed downstream in the conveyance direction H from the multiple inkjet heads 51, and the UV light source 62 completes curing the ink ejected by the inkjet heads 51.

As shown in FIG. 1, another inkjet head 52 is disposed downstream in the conveyance direction H from the UV light source 62. This inkjet head 52 is disposed at a position with a specific gap to the surface of the medium M wound around the platen drum 30, and ejects transparent ink to the medium M. This transparent ink is a UV ink. Another UV light source 63 is disposed downstream in the conveyance direction H from the inkjet head 52. This UV light source 63 emits more UV light than the upstream UV light sources 61, and completely cures the transparent ink ejected by the inkjet head 52 to the surface of the medium M. As a result, the transparent ink is fused to the medium M.

The printing mechanism 3 prints text, images, or other content on the medium M by ejecting ink and curing the ink on the medium M wound around the outside surface of the platen drum 30. The printed medium M is then conveyed by the back drive roller 32 to the take-up device 4.

The take-up device 4 has a take-up spindle 25 on which the leading end of the medium M is wound, and a follower roller 41 around which the back side of the medium M travels between the take-up spindle 25 and the back drive roller 32. The take-up spindle 25 takes up and supports the end of the medium M so that the printed surface of the medium M faces the outside, or in other words, so that the back of the medium M contacts the follower roller 41. When the take-up spindle 25 turns clockwise as seen in FIG. 1, the medium M conveyed from the back drive roller 32 passes over the follower roller 41 and is rewound onto the take-up spindle 25. The medium M is wound onto the take-up spindle 25 through a core (not shown in the figure) that removably attaches to the take-up spindle 25. When the medium M is completely wound onto the take-up spindle 25, the core and medium M can be removed. Note that the take-up spindle 25 is turned by drive power from a motor not shown connected to the take-up spindle 25 through a power transfer mechanism.

The printer 1 also has sensors including a tension sensor 74 (FIG. 2), an edge sensor 75, and a mark sensor 76 (detection device).

A tension sensor 74 is disposed, for example, to each of follower roller 21, follower roller 34, and follower roller 41.

The tension sensor 74 disposed to follower roller 21 detects the tension on the medium M (that is, slack in the medium M) from the delivery spindle 20 to the front drive roller 31, and outputs the detection result to the controller 100 (FIG. 2) described below.

The controller 100, based on the input detection result, controls rotation of the delivery spindle 20, and adjusts the tension on the medium M from the delivery spindle 20 to the front drive roller 31.

The tension sensor 74 disposed to follower roller 34 detects the tension on the medium M from the front drive roller 31 to the back drive roller 32, and outputs the detection result to the controller 100 (FIG. 2) described below.

The controller 100, based on the input detection result, controls rotation of the back drive roller 32, and adjusts the tension on the medium M from the front drive roller 31 to the back drive roller 32.

The tension sensor 74 disposed to follower roller 41 detects the tension on the medium M from the back drive roller 32 to the take-up spindle 25, and outputs the detection result to the controller 100 (FIG. 2) described below.

The controller 100, based on the input detection result, controls rotation of the take-up spindle 25, and adjusts the tension on the medium M from the back drive roller 32 to the take-up spindle 25.

Figure 2:
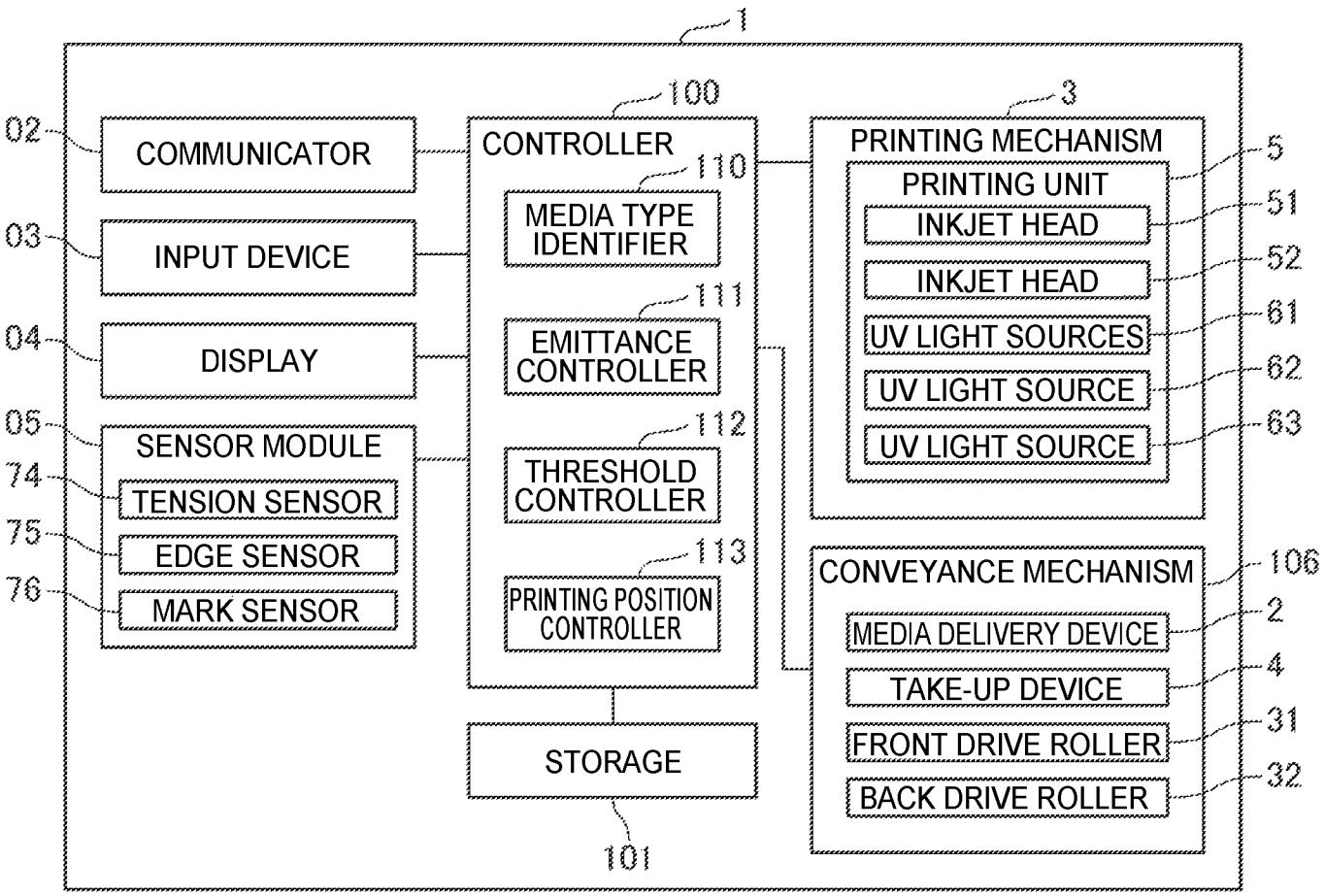
FIG. 2 illustrates the functional configuration of the printer.

The edge sensor 75 is disposed between the follower roller 21 and the front drive roller 31. The edge sensor 75 in this example is an ultrasonic sensor, detects the position of the medium M across the width (in the direction transverse to the conveyance direction H), and outputs the detection result to the controller 100 (FIG. 2). The controller 100 (FIG. 2), based on the input detection result, adjusts the position of the medium M widthwise, and suppresses skewing of the medium M while being conveyed through the conveyance path 8.

The mark sensor 76 is a sensor that detects marks on the medium M, and in this embodiment of the invention is a reflective optical sensor including an emitter that projects light onto the medium M, and a photodetector that receives and detects the reflection of the emitted light.

The emitter is embodied by a light-emitting device that varies the emittance, which is the amount of light that is projected, according to the voltage applied to the light-emitting device.

The photodetector is embodied by a photodetection device that varies the output voltage according to the amount of light received (detected).

In this embodiment of the invention a mark on the medium M is a mark that is printed on the medium M, and is a mark for managing the position of the medium M.

The mark sensor 76 detects marks based on the light detected by the photodetector, and outputs the detection result to the controller 100 (FIG. 2). The controller 100 (FIG. 2), based on the detection result, manages the position of the medium M, and executes an indexing operation setting the position of the medium M to the appropriate position when starting printing, for example.

The functional configuration of the printer 1 is described next.

FIG. 2 is a block diagram illustrating the functional configuration of the printer 1.

As shown in FIG. 2, the printer 1 includes a controller 100, storage 101, a communicator 102, an input device 103, a display 104 (reporting device), sensor module 105, printing mechanism 3, and conveyance mechanism 106.

The controller 100 includes a CPU, ROM, RAM, ASIC, and other signal processing circuits not shown, and controls other parts of the printer 1. The controller 100 executes processes by the cooperation of hardware and software, such as a CPU reading a program stored in ROM or other storage 101 to RAM, and executing the program, or executing processes by functions embedded in an ASIC, or executing processes by a signal processing circuit processing signals. The controller 100 includes function blocks such as a media type identifier 110, emittance controller 111, threshold controller 112, and a printing position controller 113. These function blocks executes processes by the cooperation of hardware and software, such as a CPU or other hardware device reading and running a program. These function blocks are described more specifically below.

The storage 101 is embodied by a hard disk drive, EEPROM, or other nonvolatile memory, and stores data rewritably.

The communicator 102, as controlled by the controller 100, communicates with a host computer or other external device, for example, by a specific communication protocol.

The input device 103 includes input means such as operating switches or a touch panel disposed to the printer 1, detects user operation of the input means, and outputs to the controller 100. The controller 100, based on input from the input device 103, then executes processes corresponding to the operation of the input means.

The display 104 is embodied by a plurality of LEDs or a display panel, for example, and as controlled by the controller 100 turns the LEDs on/off in specific patterns or displays information on the display panel. The display 104 is an example of a reporting device for reporting information to the user by displaying information.

The sensor module 105 includes the tension sensors 74, edge sensor 75, and mark sensor 76. The sensor module 105 outputs the detection results from these sensors to the controller 100. The detection results the sensor module 105 outputs to the controller 100 are current or voltage levels. Therefore, the amount of light detected by the mark sensor 76 is converted to a current or voltage (in this embodiment of the invention, a voltage) corresponding to the amount of light, and output to the controller 100. As a result, in this embodiment, the controller 100 detecting the amount of reflected light detected by the mark sensor 76 means that the controller 100 detected a voltage corresponding to the amount of light the mark sensor 76 detected.

The printing mechanism 3 is embodied by configurations such as the printing unit 5 including the inkjet heads 51, inkjet head 52, UV light sources 61, UV light source 62, and UV light source 63; a drive circuit configured to drive the inkjet heads 51 and inkjet head 52; a drive circuit for driving the UV light sources 61 to UV light source 63; and other configurations related to printing on print media.

The conveyance mechanism 106 is embodied by a motor that drives the media delivery device 2, the take-up device 4, the front drive roller 31, the back drive roller 32, and the delivery spindle 20; a motor that drives the take-up spindle 25; a motor that drives the front drive roller 31; a motor that drives the back drive roller 32; and other configurations related to conveying the print medium.

The medium M in this embodiment of the invention is described next. The medium M in this embodiment is a medium M such as shown in FIG. 3.

Figure 3:
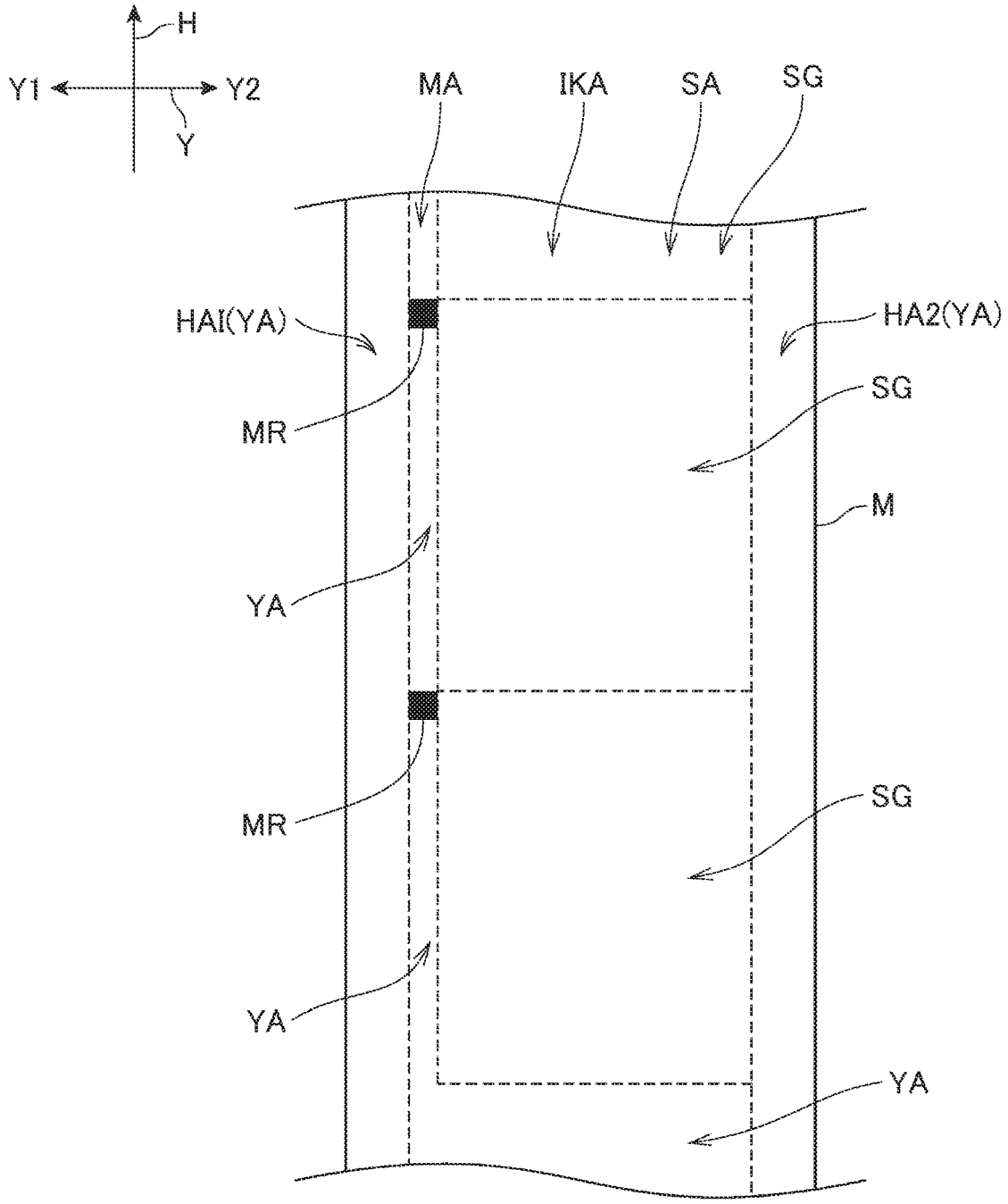
FIG. 3 shows an example of a print medium.

FIG. 3 shows an example of a medium M.

As shown in FIG. 3, the printing surface of the medium M has, in the transverse direction Y to the conveyance direction H of the medium M, or in other words, in the direction widthwise to the medium M, an unprintable area HA1 on the Y1 side, and an unprintable area HA2 on the Y2 side. The unprintable area HA1 and unprintable area HA2 are areas to which the printing mechanism 3 cannot print, that is, areas to which ink is not ejected, and are therefore also margins YA on the medium M.

Note that unprintable area HA1 and unprintable area HA2 are the same as margins YA. Note also that the margins YA are areas that have not been printed on, or areas that are not printed on, and therefore indicate white space.

As shown in FIG. 3, the printing surface of the medium M has a printing area IKA on the transverse direction Y between unprintable area HA1 and unprintable area HA2.

This printing area IKA is the area to which the printing mechanism 3 can print, or in other words the area to which ink can be ejected.

In this embodiment of the invention, a mark MR and a main image SG such as text, images, or other content not including a mark MR, is printed by the printing mechanism 3 in the printing area IKA. The mark MR is not preprinted on the medium M, and instead is printed by the printing mechanism 3. The controller 100 prints a mark MR and main image SG in the printing area IKA by the printing mechanism 3 based on image data representing images including a mark MR and a main image SG. As a result, a mark printing area MA in which a mark MR is printed, and a main image printing area SA in which a main image SG is printed, is formed in the printing area IKA after printing.

Note that the larger the mark MR, the more the mark printing area MA extends in the transverse direction Y, and the narrower the main image printing area SA becomes in the transverse direction Y. Note that the margins YA are the area where a mark MR and main image SG are not printed in the printing area IKA.

As described above, a mark MR is a mark used for indexing to set the position of the medium M to the appropriate position to start printing. As a result, in this embodiment of the invention, the marks MR are printed on the medium M at an equal interval in the conveyance direction H. Because nothing is printed in the mark printing area MA between one mark MR and the next mark MR, these areas are also margins YA.

Note that the color of the medium M may differ according to the medium M, and may be white, black, or other color. As a result, the color of the mark MR printed on the medium M may also differ according to the difference in the color of the medium M. This is because if the marks MR and medium M are the same color, accurately detecting the marks MR may not be possible.

As described above, this embodiment of the invention detects marks MR based on light emitted by the mark sensor 76. More specifically, the mark sensor 76 projects light onto the marks MR, and detects the marks MR based on the amount of emitted light that is reflected (that is, based on the reflection of light by a mark MR). Therefore, depending on the color of the mark MR, the reflection of the emitted light may exceed the amount of light that can be detected by the mark sensor 76 (in other words, the reflection may saturate the detection level), and detecting the marks MR may not be possible. This problem occurs particularly when the amount of light reflected by the mark MR is greater than the amount of light reflected by the medium M. This also means that the printer 1 cannot correctly index the medium M.

A printer 1 according to this embodiment of the invention therefore executes the operation described below.

The operation of the printer 1 is described below by describing the operation of the media type identifier 110, emittance controller 111, threshold controller 112, and printing position controller 113, which are function blocks of the controller 100.

Figure 4:
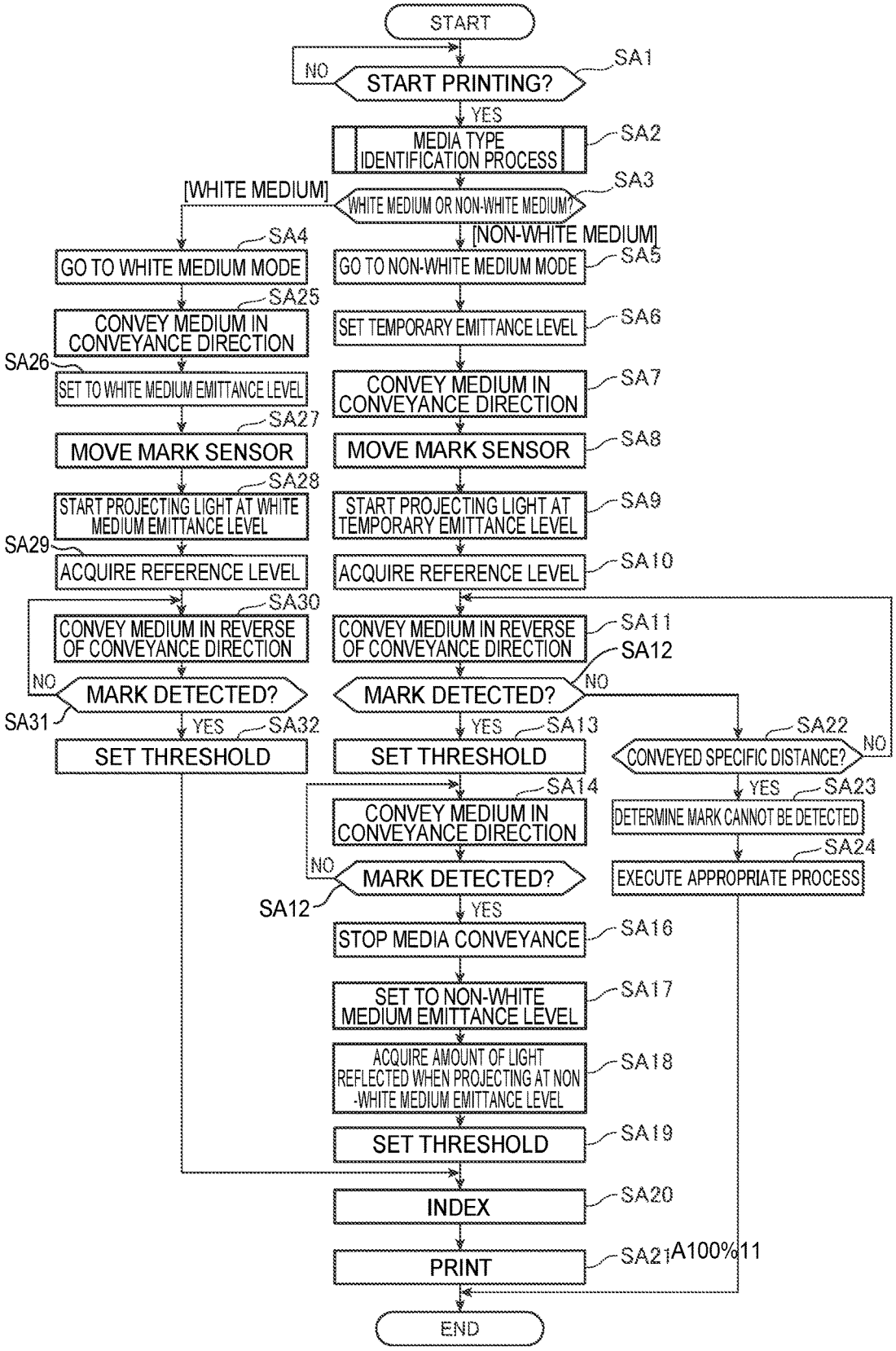
FIG. 4 is a flow chart of an operation of the printer 1.

FIG. 4 is a flow chart illustrating the operation of the printer 1.

Below, a medium M that is white is referred to as a white medium (a print medium that is white), and a medium M that is a color other than white is referred to as a non-white medium (a print medium that is a color other than white).

Note that below "white" is the color that reflects the greatest amount of light.

The controller 100 of the printer 1 first determines whether or not to start printing by the printing mechanism 3 (step SA1).

For example, if the input device 103 detects an operation corresponding to a command to start printing, and a detection result indicating such an operation is input from the input device 103, the controller 100 determines to start printing by the printing mechanism 3 (step SA1: YES). In addition, if printing was interrupted for cleaning or flushing, for example, when the cleaning or flushing operation ends, the controller 100 determines to start printing by the printing mechanism 3 when triggered by the end of the maintenance operation (step SA1: YES).

Note that cleaning is an operation that forcibly suctions remaining ink from the nozzles of the inkjet heads 51 and inkjet head 52. Flushing is an operation that forcibly ejects remaining ink from the nozzles of the inkjet heads 51 and inkjet head 52.

In addition, if printing is interrupted by an error in the printer 1, and the error is then resolved, the controller 100 determines to start printing by the printing mechanism 3 when triggered by resolution of the error (step SA1: YES).

Next, when the controller 100 determines to start printing by the printing mechanism 3 (step SA1: YES), the controller 100 executes a media type identification process (step SA2). The media type identification process is a process that identifies the type of medium M. In this embodiment of the invention, the type of the medium M is a type corresponding to the color of the medium M. As a result, the media type identification process is a process of determining if the type of the medium M is a white medium or a non-white medium.

Figure 5:
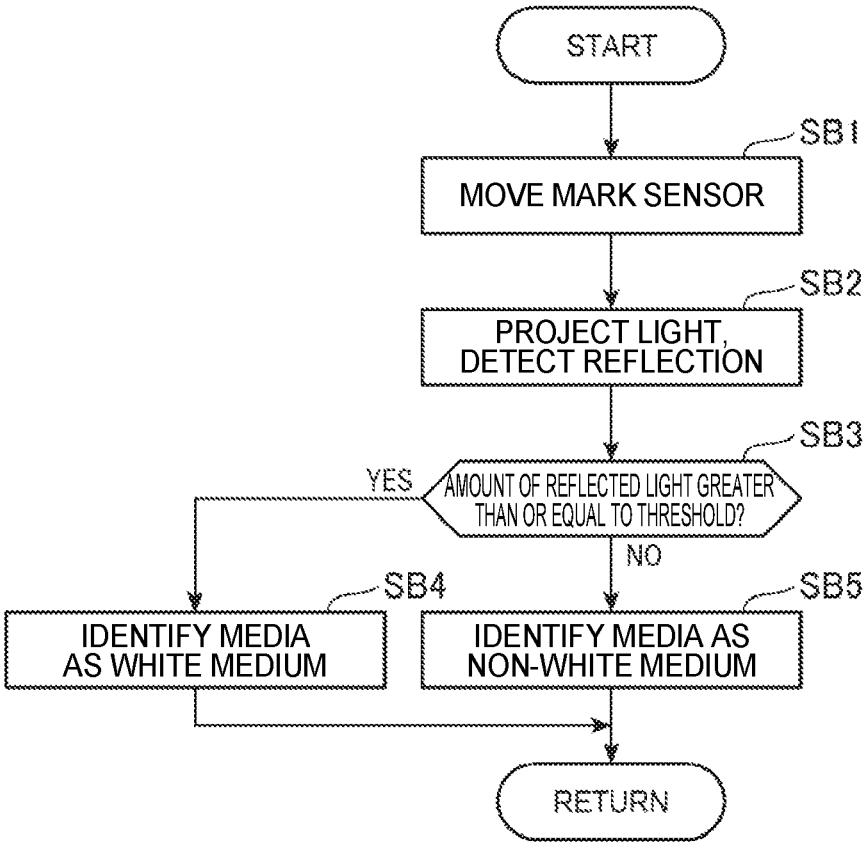
FIG. 5 is a flow chart of an operation of the printer in the media type identification process.

FIG. 5 is a flow chart of the operation of the printer 1 in the media type identification process.

The media type identifier 110 of the controller 100 of the printer 1 moves the mark sensor 76 so that the position to which the mark sensor 76 emits light is set to the position of the unprintable area HA1 or the unprintable area HA2 on the medium M (step SB1).

Note that if the width of the medium M (the length across the medium M on the transverse direction Y in FIG. 3) is previously set, and the width of the unprintable area HA1 and unprintable area HA2 are set relative to the width of the medium M, the media type identifier 110 can uniquely identify the areas where the unprintable area HA1 and the unprintable area HA2 are on the printing surface of the medium M.

Unnecessary movement of the mark sensor 76 when moving the mark sensor 76 in step SB1 can be prevented by executing the following operation. As shown in FIG. 3, the marks MR are printed to the Y1 side of the medium M in this embodiment of the invention. Therefore, at the start of step SB1, the probability that the mark sensor 76 is positioned toward the Y1 side from the center of the medium M on the transverse direction Y is high. in other words, when step SB1 starts, the probability is high that the mark sensor 76 is already positioned closer to the unprintable area HA1 than to unprintable area HA2.

If in step SB1 the mark sensor 76 is moved toward the unprintable area HA2 to set the position to which the mark sensor 76 emits light to unprintable area HA2 even though unprintable area HA1 is closer, the mark sensor 76 will be moved unnecessarily. Therefore, when the marks MR are printed at the position shown in FIG. 3, the media type identifier 110 moves the mark sensor 76 to approach the unprintable area HA1 in step SB1. As a result, the media type identifier 110 can prevent moving the mark sensor 76 unnecessarily.

When the mark sensor 76 is moved, the media type identifier 110 controls the mark sensor 76 to emit light to either unprintable area HA1 or unprintable area HA2 and detect the reflection of the emitted light (step SB2). The amount of light emitted in step SB2 is an amount of light within the range enabling the mark sensor 76 to detect the reflection of the emitted light when the medium M is a white medium. This emitted amount of light is previously set by tests or simulations.

Next, the media type identifier 110, based on the output of the mark sensor 76, determines whether or not the amount of reflected light detected by the mark sensor 76 is an amount of light greater than or equal to the threshold indicating a white medium (step SB3).

Note that this decision is based on the voltage corresponding to the amount of light detected. As described above, in this embodiment of the invention white is the color that reflects the greatest amount of light. Therefore, no color other than white reflects light greater than or equal to the threshold (that is, white is the only color that may reflect light exceeding the threshold).

As a result, if the media type identifier 110 determines that the amount of reflected light detected by the mark sensor 76 is an amount of light exceeding the threshold indicating a white medium (step SB3: YES), the media type identifier 110 determines the type of medium M is a white medium (step SB4).

However, if the media type identifier 110 determines that the amount of reflected light detected by the mark sensor 76 is an amount of light below the threshold indicating a white medium (step SB3: NO), the media type identifier 110 determines the type of medium M is a non-white medium (step SB5).

As described above, the media type identifier 110 projects light by the mark sensor 76 onto either unprintable area HA1 or unprintable area HA2, that is, in a margin YA, and based on the amount of light reflected, determines the type of medium M. As described above, unprintable area HA1 and unprintable area HA2 are areas to which ink is not ejected and in which nothing is printed. Therefore, by using the unprintable area HA1 or unprintable area HA2, the media type identifier 110 can more accurately determine the type of medium M than in the printing area IKA where there is a high probability that ink may be ejected.

Note that the media type identification process above describes the mark sensor 76 emitting light to either unprintable area HA1 or unprintable area HA2, but may be configured to project light to the area between one mark MR and another mark MR in the mark printing area MA. Because the area between one mark MR and another mark MR in the mark printing area MA is a margin YA, the same effect as described above can be achieved.

Furthermore, the media type identification process is a process of determining whether the type of medium M is a white medium or a non-white medium, and is not limited to the foregoing. If the color of the medium M is previously set and information indicating the color setting is stored in storage 101, the media type identifier 110 may identify the type of medium M based on the information stored in the storage 101 indicating the color.

For example, if the storage 101 stores information indicating white, the media type identifier 110 determines the type of the medium M is a white medium. If the storage 101 stores information indicating a color other than white, the media type identifier 110 determines the type of the medium M is a non-white medium.

Returning to the flow chart in FIG. 4, after the media type identification process executes in step SA2, the controller 100 determines whether the medium M is a white medium or a non-white medium based on the type of medium M identified in the media type identification process (step SA3).

If the media type identifier 110 determines in the media type identification process that the type of medium M is a white medium, the controller 100 determines the medium M is a white medium (step SA3: white medium), and sets the operating mode of the printer 1 to a white medium mode (first mode) (step SA4). The white medium mode is a mode for detecting marks MR and indexing the medium M when the medium M is a white medium. In other words, the white medium mode is the operating mode selected when the medium M to be indexed is a white medium.

However, if the media type identifier 110 determines in the media type identification process that the type of medium M is a non-white medium, the controller 100 determines the medium M is a non-white medium (step SA3: non-white medium), and sets the operating mode of the printer 1 to a non-white medium mode (second mode) (step SA5). The non-white medium mode is a mode for detecting marks MR and indexing the medium M when the medium M is a non-white medium. In other words, the non-white medium mode is the operating mode selected when the medium M to be indexed is a non-white medium.

Operation of the printer 1 when the operating mode is the white medium mode, and operation of the printer 1 when the operating mode is the non-white medium mode, are described below.

Non-White Medium Mode

Operation of the printer 1 when the operating mode of the printer 1 is the non-white medium mode is described first.

When the operating mode of the printer 1 is set to the non-white medium mode, the emittance controller 111 of the controller 100 sets the emittance level of the light projected by the mark sensor 76 to a temporary emittance level (third level) (step SA6).

The emittance controller 111 sets the gain of the voltage output to the emitter so that the voltage output to the emitter of the mark sensor 76 goes to the voltage setting the emittance level of the light projected by the mark sensor 76 to the temporary emittance level, and sets the emittance level of the light projected by the mark sensor 76 to the temporary emittance level.

This temporary emittance level is an amount of light previously set by tests or simulations, and is an amount of light within the range enabling the mark sensor 76 to detect the reflection of the emitted light even when projected onto a white mark MR.

When the emittance controller 111 sets the emittance level of the light projected by the mark sensor 76 to the temporary emittance level, the controller 100 conveys the medium M in the conveyance direction H by the conveyance mechanism 106 so that the main image SG located on the medium M farthest upstream in the conveyance direction H is positioned downstream in the conveyance direction H from at least the position of the mark sensor 76 (step SA7).

Next, the controller 100 moves the mark sensor 76 so that the position to which the mark sensor 76 projects light is set to a position in the mark printing area MA in the transverse direction Y (step SA8).

Note that when the width of the medium M (the length across the medium M on the transverse direction Y in FIG. 3) is previously set and the position where a mark MR is printed widthwise to the medium M can be determined from the print data, for example, the controller 100 can uniquely identify where the mark printing area MA is located widthwise to the printing surface of the medium M (on the transverse direction Y).

Next, the controller 100 starts projecting light at the temporary emittance level set in step SA6 while moving the mark sensor 76 (step SA9).

Next, once projecting light at the temporary emittance level starts, the controller 100 receives the reflection by the mark sensor 76, and acquires the detected light level as a reference light level used as a reference for detecting marks MR (step SA10). Because the medium M is conveyed in step SA7, in step SA10 the position on the medium M to which light is projected by the mark sensor 76 is in a margin YA where nothing is printed on the printing surface of the medium M. Therefore, in step SA10, the controller 100 acquires as the reference light level the amount of light reflected in the margin YA of the medium M. Note that, more specifically, the controller 100 acquires the voltage corresponding to the reference light level as the reference light level.

Next, the controller 100, once the reference light level is acquired, conveys the medium M opposite the normal conveyance direction H of the medium M by the conveyance mechanism 106 (step SA11).

Next, the controller 100, based on the detection result input from the mark sensor 76, determines whether or not a mark MR was detected while conveying the medium M in the opposite direction as the conveyance direction H (step SA12).

Step SA12 is described in detail next.

Figure 6:
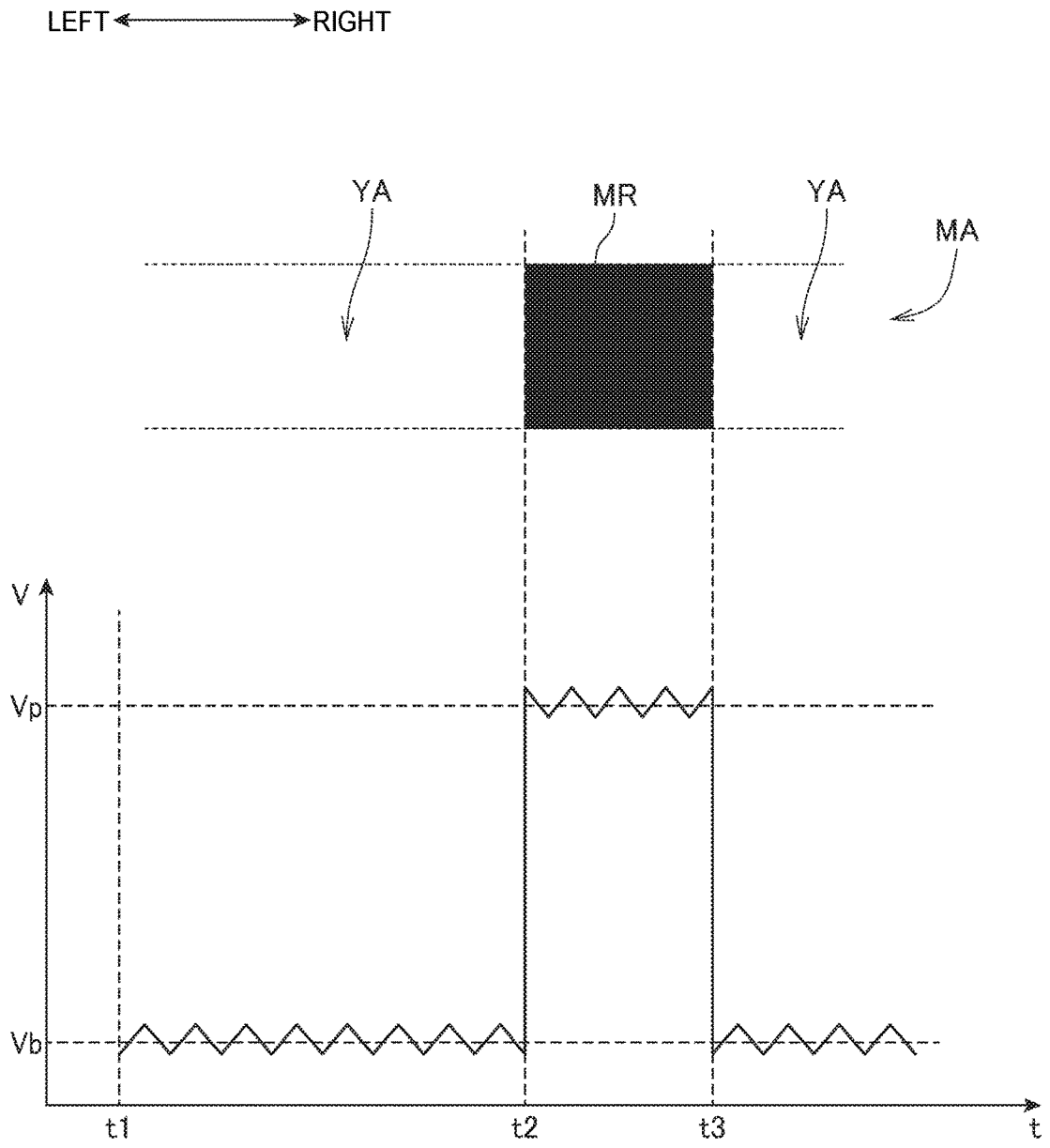
FIG. 6 describes mark detection.

FIG. 6 describes detecting a mark MR. The vertical axis in FIG. 6 shows voltage, and the horizontal axis shows time. The voltage on the vertical axis in FIG. 6 is the voltage corresponding to the amount of reflected light detected by the mark sensor 76. Note that voltage is shown on the vertical axis in FIG. 6 because the detection result the mark sensor 76 outputs to the controller 100 is a voltage.

In FIG. 6, the amount of reflected light from the mark MR is greater than the amount of reflected light from the margin YA of the medium M. Also in FIG. 6, voltage Vb is the voltage corresponding to the reference light level acquired in step SA10.

As also indicated by the arrows, in the description referring to FIG. 6 the direction to the left is referred to as left, and the direction to the right is referred to as right.

Furthermore, when the medium M is conveyed, the mark MR moves to the left with the medium M in FIG. 6, and the position on the medium M to which the mark sensor 76 projects light moves relatively to the right.

When a reference light level is acquired at time t1, the controller 100 conveys the medium M opposite the conveyance direction H by the conveyance mechanism 106 after time t1 while monitoring the amount of reflected light detected by the mark sensor 76. From time t1 to time t2 in FIG. 6, the voltage corresponding to the amount of reflected light is voltage Vb because light is reflected from the margin YA on the left in the mark printing area MA. Note that the voltage referenced to voltage Vb fluctuates from time t1 to time t2 because specific noise is superimposed when the mark sensor 76 detects the reflected light.

When the position of the light projected by the mark sensor 76 reaches the mark MR at time t2, the amount of reflected light detected by the mark sensor 76 changes, and the voltage corresponding to the amount of light detected by the mark sensor 76 goes to voltage Vp, which is higher than voltage Vb. From time t2, the controller 100 continues monitoring the amount of reflected light detected by the mark sensor 76 while conveying the medium M opposite the conveyance direction H by the conveyance mechanism 106.

At time t3, when the position to which the light projected by the mark sensor 76 moves away from the mark MR and enters the margin YA on the right side of the mark printing area MA, the amount of reflected light detected by the mark sensor 76 changes, and the voltage corresponding the amount of reflected light detected by the mark sensor 76 returns to voltage Vb. Note that the voltage referenced to voltage Vp fluctuates from time t2 to time t3 because specific noise is superimposed when the mark sensor 76 detects the reflected light.

As shown in FIG. 6, if the voltage corresponding to the amount of reflected light detected exceeds the voltage Vp set in step SA10, and then returns to voltage Vp, the controller 100 determines a mark MR was detected. Note that as shown in FIG. 6, noise is superimposed on the voltage corresponding to the detected light. As a result, the controller 100 determines a mark MR was detected if the voltage corresponding to the amount of reflected light detected goes to a voltage a specific multiple of the voltage Vp and then returns to voltage Vp.

Referring again to the flow chart in FIG. 4, if the controller 100 determines in step SA12 that a mark MR was detected (step SA12: YES), the threshold controller 112 sets the threshold of the light the mark sensor 76 detects as a mark MR when light is projected at the temporary emittance level (step SA13). More specifically, the threshold controller 112, in step SA13, sets the median between the reference light level set in step SA10 and the amount of reflected light detected from the mark MR, as the threshold level of light the mark sensor 76 detects as the mark MR when emitting at the temporary emittance level. In other words, the threshold controller 112 sets as the threshold the median between the amount of reflected light detected in the margin YA of the medium M, and the amount of reflected light detected from the mark MR.

Setting the median between the amount of reflected light detected in the margin YA of the medium M, and the amount of reflected light detected from the mark MR, as the threshold of the amount of light the mark sensor 76 detects from a mark MR when projecting light at the temporary emittance level has the following effect.

Figure 7:
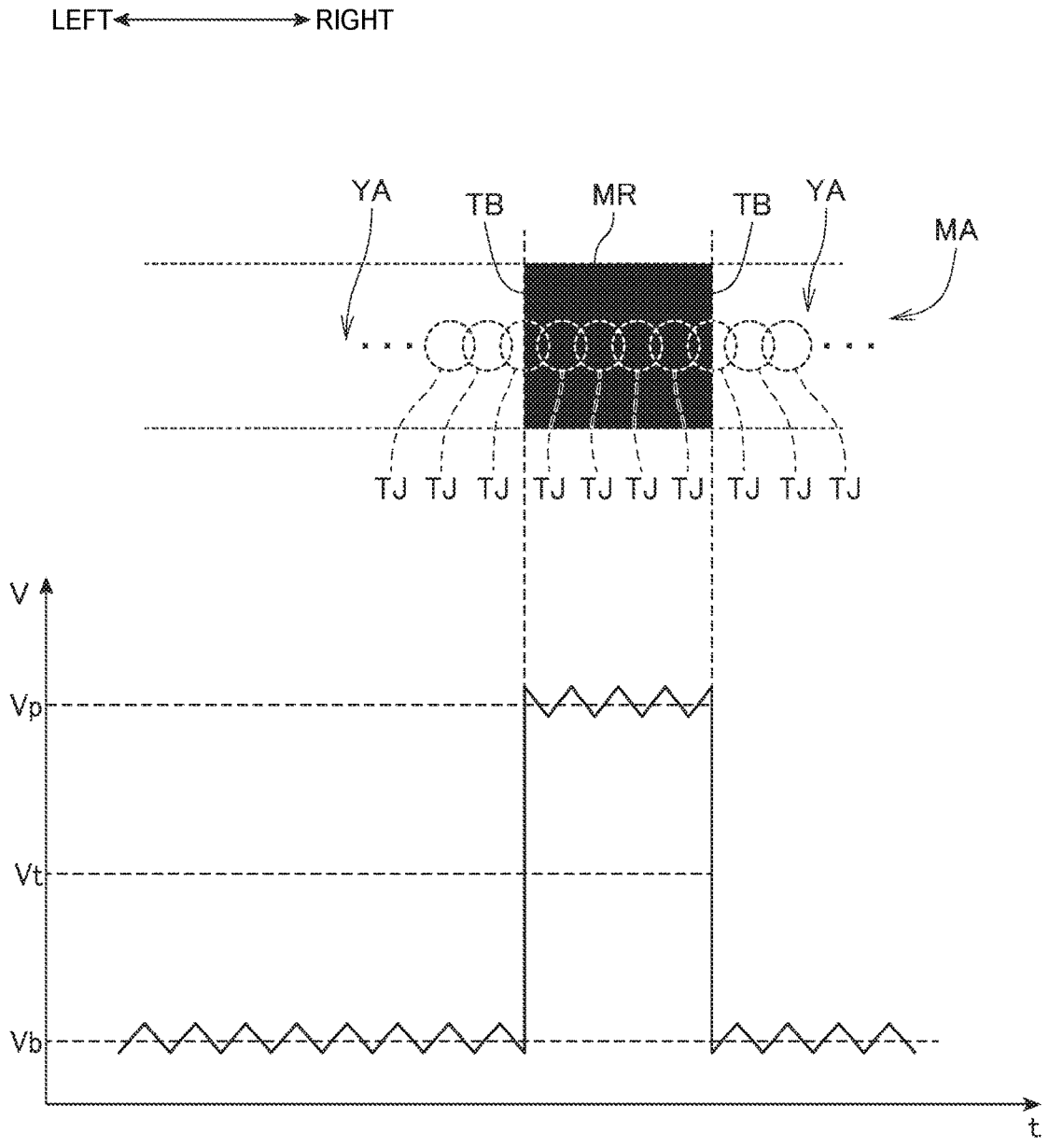
FIG. 7 describes setting a threshold value.

FIG. 7 illustrates setting the threshold. Note that voltage is shown on the vertical axis in FIG. 7, and time is shown on the horizontal axis. The voltage shown on the vertical axis in FIG. 7 is the voltage corresponding to the amount of reflected light detected by the mark sensor 76.

In FIG. 7, the amount of reflected light from the mark MR is greater than the amount of reflected light from the margins YA of the medium M. Also in FIG. 7, voltage Vb is the voltage corresponding to the reference light level acquired in step SA10, and voltage Vp is the voltage corresponding to the amount of light reflected from the mark MR when light is projected at the temporary emittance level.

Also in FIG. 7, light is projected onto the medium M in a round projection state TJ.

As shown in FIG. 7, in the margin YA of the mark printing area MA, the voltage corresponding to the amount of reflected light is voltage Vb because the entire projection area of projection state TJ is located inside the margin YA. As also shown in FIG. 7, in the mark MR, the voltage corresponding to the amount of reflected light is voltage Vp because the entire projection area of projection state TJ is located inside the mark MR.

At the boundary between the mark MR and the margin YA, that is, at the edge TB of the mark MR, the projection area of projection state TJ includes both the margin YA and the mark MR. More specifically, the closer the position of the projected light gets to the mark MR, the projection area of projection state TJ moves over the mark MR near the edge TB of the mark MR, and as the position of the projected light leaves the mark MR, the projection area of projection state TJ moves over the margin YA. Therefore, the position where the projected light encroaches the edge TB of the mark MR, half of the projection area of projection state TJ is shown over the margin YA and the other half is shown over the mark MR. The amount of reflected light at the edge TB of the mark MR is therefore an amount half way between the amount of reflected light from the margin YA and the amount of reflected light from the mark MR.

Therefore, the threshold controller 112, in step SA13, sets the median between the amount of light reflected in the margin YA of the medium M and the amount of light reflected in the mark MR as the threshold level of the amount of light the mark sensor 76 detects when light is projected at the temporary emittance level. As a result, the threshold controller 112 can accurately detect both edges TB of the mark MR, and can accurately detect the marks MR on the medium M. In addition, by setting the threshold in step SA13, the threshold controller 112 can prevent detecting as a mark MR any marks other than actual marks MR.

Referring again to the flow chart in FIG. 4, once the threshold of the amount of light the mark sensor 76 detects as a mark MR when projecting light at the temporary emittance level is set in step SA13, the controller 100 projects light at the temporary emittance level, conveys the medium M in the conveyance direction H while monitoring the amount of reflected light (step SA14), and determines if a mark MR was detected (step SA15).

When the controller 100 determines a mark MR was detected (step SA15: YES), the controller 100 stops conveying the medium M at the position where the mark MR was detected (step SA16). However, if a mark MR was not detected (step SA15: NO), the controller 100 continues conveying the medium M by the conveyance mechanism 106 to a position where a mark MR is detected.

When the medium M is conveyed to a position where the light projected by the mark sensor 76 is on a mark MR, the emittance controller 111 sets the emittance level of light the mark sensor 76 projects at this position to a non-white medium emittance level (second emittance level) (step SA17). Note that setting the emittance level in step SA17 is done the same way as described in step SA6.

The non-white medium emittance level is the emittance level of light projected on the mark MR resulting in the amount of light reflected from a mark MR printed on a non-white medium going to the maximum level of light the mark sensor 76 can detect.

In this way, the emittance controller 111 detects a mark MR by light at the temporary emittance level in the non-white medium mode, and based on the detected mark MR, sets the emittance level of the projected light to the non-white medium emittance level. As a result, even if a white mark is printed on a black medium M, the amount of light reflected by the mark MR will not exceed the range of light that the mark sensor 76 can detect. The controller 100 can therefore accurately detect marks MR printed on a non-white medium by the mark sensor 76. The controller 100 can therefore appropriately index the medium M even when the medium M is a non-white medium.

In this embodiment of the invention marks MR are printed as images on the printing surface of the medium M. In other words, depending on the image desired by the user, the marks MR printed on a non-white medium are not limited to a single color. As a result, in a configuration that detects and indexes marks MR at a single emittance level, the amount of light reflected by the marks MR may exceed the detection range of the mark sensor 76 depending on the color the marks MR printed on a non-white medium.

The controller 100 therefore first detects a mark MR at the temporary emittance level, and sets the emittance level of the projected light based on the detected mark MR as the non-white medium emittance level. As a result, the controller 100 can accurately detect marks MR using light at the temporary emittance level independently of the color of the marks MR printed on a non-white medium, and can set the non-white medium emittance level appropriately according to the color of the marks MR printed on a non-white medium.

Next, after the emittance level of the light projected by the mark sensor 76 is set to the non-white medium emittance level, the controller 100 conveys the medium M, and acquires the amount of light reflected in the margins YA on the upstream side and downstream side in the conveyance direction H from the mark MR where the non-white medium emittance level was set, and the amount of light reflected by the mark MR (step SA18). In step SA16, the controller 100, by the mark sensor 76, acquires the amount of light reflected when light is projected at the non-white medium emittance level. Note that the amount of light the controller 100 acquires indicates the voltage acquired at that emittance level.

Next, when the amount of light reflected by the margin YA and the amount of light reflected by the mark MR are acquired with light projected at the non-white medium emittance level, the threshold controller 112 sets the threshold for the amount of light at which the mark sensor 76 detects a mark MR when light is projected at the non-white medium emittance level (step SA19). Similarly to when setting the threshold in step SA13, the controller 100 sets the median between the amount of reflected light detected in the margin YA of the medium M, and the amount of light reflected by a mark MR, as the threshold of the amount of light at which the mark sensor 76 detects a mark MR when light is projected at the non-white medium emittance level.

As a result, the controller 100 can detect both edges TB of the mark MR with good accuracy, and can detect the marks MR on the medium M with good accuracy even when even when light is projected at the non-white medium emittance level. Furthermore, by setting the threshold in step SA17, the threshold controller 112 can prevent detecting as a mark MR any marks other than actual marks MR.

When the threshold at which the mark sensor 76 detects marks MR when light is projected at the non-white medium emittance level is set, the controller 100 detects marks MR while projecting light at the non-white medium emittance level, and indexes the medium M (step SA20).

As described above, because the controller 100 can accurately detect marks with the mark sensor 76, the controller 100 can appropriately index the medium M even when the medium M is a non-white medium. In addition, once the medium M is indexed, the controller 100 starts printing based on print data (step SA21).

Returning to the description of step SA12 in the flow chart in FIG. 4, when it is determined that a mark MR was not detected, (step SA12: NO), the controller 100 determines whether or not the medium M was conveyed a specific distance in reverse of the conveyance direction H (step SA22). The specific distance used here is a specific multiple of the length of the main image SG in the conveyance direction H. The length of the main image SG can be uniquely determined based on the print data referenced to print the main image SG.

If the controller 100 determines the medium M was not conveyed the specific distance in reverse of the conveyance direction H (step SA22: NO), the process returns to step SA11. However, if the controller 100 determines the medium M was conveyed the specific distance in reverse of the conveyance direction H (step SA22: YES), the controller 100 determines a mark MR cannot be detected (step SA23), and executes a process corresponding to when a mark MR cannot be detected (step SA24). Several examples of a process corresponding to when a mark MR cannot be detected are described below.

Example 1

In a first example, the controller 100 reports information indicating an error by displaying on the display 104 information indicating an error. The error in this example is that a mark MR cannot be detected. In other words, the controller 100 informs the user by displaying on the display 104 information indicating a mark MR cannot be detected. As a result, the user can know that the printer 1 cannot detect marks MR on the medium M.

In conjunction with information indicating a mark MR cannot be detected, the controller 100 may also present information instructing the user to manually align the position of the mark MR with the position to which the mark sensor 76 projects light. As a result, the user can know that the user needs to align the position of the mark MR and the position to which the mark sensor 76 projects light.

Example 2

In a second example, the printing position controller 113 of the controller 100 projects light to the main image printing area SA of the medium M, and based on the amount of reflected light, determines the indexing position. The indexing position is the position from which printing starts.

First, the printing position controller 113 moves the mark sensor 76 in the transverse direction Y so that the position to which the mark sensor 76 projects light is positioned to the main image printing area SA on the printing surface of the medium M. Next, the printing position controller 113, while moving the medium M a specific distance in the conveyance direction H, monitors for change in the amount of light reflected when the mark sensor 76 emits light to the main image printing area SA. The printing position controller 113 then determines the area where change in the amount of reflected light drops and the amount of reflected light becomes substantially constant. The printing position controller 113 then determines the position in the identified range furthest downstream in the conveyance direction H as the indexing position.

The operation of the printing position controller 113 in this second example is described further below with reference to the figures.

Figure 8:
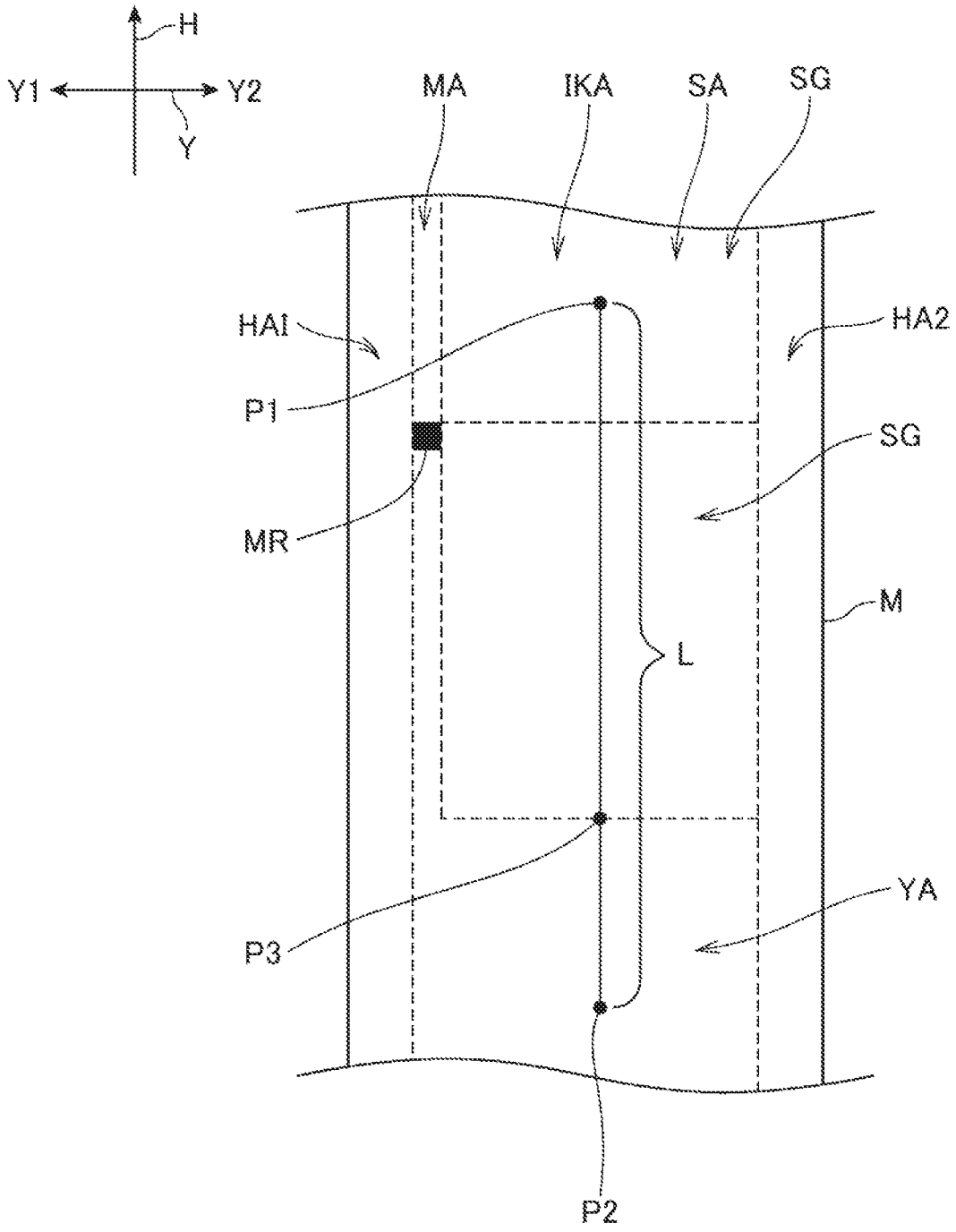
FIG. 8 describes a process according to a second example.

FIG. 8 describes the process corresponding to this second example. In FIG. 8 and FIG. 3, like parts are identified by like reference numerals, and further description thereof is omitted.

In FIG. 8, position P1 in the main image printing area SA of the medium M is the position to which the mark sensor 76 projects light before the medium M is conveyed in the conveyance direction H.

The printing position controller 113 conveys the medium M by the conveyance mechanism 106 a distance L in the conveyance direction H until the position to which the mark sensor 76 projects light moves from position P1 to position P2.

This distance L is preferably greater than the length in the conveyance direction H of the main image SG printed on the medium M farthest upstream in the conveyance direction H. This is because to determine the indexing position, the amount of light reflected in the area where the main image SG is printed and in the margin YA must be acquired.

Note that the length of the main image SG in the conveyance direction H can be uniquely determined based on the print data referenced to print the main image SG.

When the printing position controller 113 has conveyed the medium M until the position to which the mark sensor 76 projects light reaches position P2, the printing position controller 113 determines, based on the amount of reflected light acquired during conveyance of distance L, the area where change in the amount of reflected light is low, or in other words, the area where the amount of reflected light is substantially constant.

In the example in FIG. 8, the main image SG is printed in the main image printing area SA from position P1 to position P3. Therefore, the range from position P1 to position P3 is the range where change in the amount of reflected light is great.

Also in FIG. 8, the area from position P3 to position P2 is a margin YA where the main image SG is not printed. Therefore, the range from position P3 to position P2 is a range where change in the amount of reflected light is small, or in other words, the area where the amount of reflected light is substantially constant.

In the example in FIG. 8, the printing position controller 113 identifies the range from position P3 to position P2 as the area where the amount of reflected light is substantially constant. Once the range from position P3 to position P2 is identified, the printing position controller 113 identifies the position in this range that is farthest upstream in the conveyance direction H. In the example in FIG. 8, the printing position controller 113 identifies position P3 as this position. The printing position controller 113 then sets position P3 as the indexing position.

As described above, when a mark MR cannot be detected, the printing position controller 113 conveys the medium M by the conveyance mechanism 106 while projecting light at the temporary emittance level to the main image printing area SA of the medium M, and detects the position corresponding to the border between the main image SG and the margin YA. The printing position controller 113 then identifies this position as the indexing position for the medium M. As a result, the printing position controller 113 can index the medium M even when marks MR on the medium M cannot be detected.

Note that in the second example the conveyance mechanism 106 the conveyance speed of the medium M is slower than the conveyance speed when printing on the medium M. As a result, change in the reflection from the printing surface of the medium M can be accurately acquired, and the printing position controller 113 can accurately detect the position corresponding to the border between the main image SG and the margin YA, that is, the indexing position.

Therefore, the controller 100 can accurately index the medium M even when marks MR on the medium M cannot be detected.

Note that the foregoing second example describes determining the indexing position by conveying the medium M once, but the indexing position may be determined by executing this operation multiple times at different positions on the main image printing area SA. As a result, the printing position controller 113 can accurately determine the indexing position even when the main image SG is an image of a striped pattern, for example.

Furthermore, in the second example, the mark sensor 76 may be moved bidirectionally widthwise to the medium M while conveying the medium M to identify the margins YA. When an image is printed on only part of the medium M, this configuration can avoid the controller 100 mistakenly determining an image is not printed even though an image is printed because the mark sensor 76 is set to a position widthwise to the medium M where an image is not printed.

White Medium Mode

Operation of the printer 1 when the operating mode of the printer 1 is the white medium mode is described next.

When the operating mode of the printer 1 is set to the white medium mode, the emittance controller 111 conveys the medium M by the conveyance mechanism 106 in the conveyance direction H so that the main image SG located on the medium M farthest upstream in the conveyance direction H is positioned downstream in the conveyance direction H from at least the position of the mark sensor 76 (step SA25). More specifically, the emittance controller 111 conveys the medium M in the conveyance direction H until the position to which the mark sensor 76 projects light is at a position other than on a mark MR on the medium M, that is, is in the margin YA.

Next, the emittance controller 111, based on the amount of light reflected from the margin YA, sets the emittance level of light the mark sensor 76 projects to a white medium emittance level (first emittance level) (step SA26). This white medium emittance level is an amount of light previously set by tests or simulations, and is an amount of light where the amount of reflected light is in the detection range of the mark sensor 76 even when the mark sensor 76 projects light onto a white mark.

When the emittance controller 111 sets the emittance level of the light projected by the mark sensor 76 to the white medium emittance level, the controller 100 conveys the medium M so that the position to which the mark sensor 76 projects light is in the mark printing area MA on the transverse direction Y (step SA27). Note that as described above, when the width of the medium M (the length across the medium M on the transverse direction Y in FIG. 3) is previously set, and the position where a mark MR is printed widthwise to the medium M can be determined from the print data, for example, the controller 100 can uniquely identify where the mark printing area MA is located widthwise to the printing surface of the medium M (on the transverse direction Y).

Next, the controller 100 starts projecting light at the white medium emittance level set in step SA26 while moving the mark sensor 76 (step SA28).

Next, once projecting light at the white medium emittance level starts, the controller 100 receives the reflection by the mark sensor 76, and acquires the detected light level as a reference light level used as a reference for detecting marks MR (step SA29). Because the medium M is conveyed in step SA26, in step SA29 the position on the medium M to which light is projected by the mark sensor 76 is in a margin YA where nothing is printed on the printing surface of the medium M. Therefore, in step SA29, the controller 100 acquires as the reference light level the amount of light reflected in the margin YA of the medium M.

Next, the controller 100, once the reference light level is acquired, conveys the medium M opposite the normal conveyance direction H of the medium M by the conveyance mechanism 106 (step SA30).

Next, the controller 100, based on the detection result input from the mark sensor 76, determines whether or not a mark MR was detected while conveying the medium M in the opposite direction as the conveyance direction H (step SA30).

Step SA30 is described in detail next.

Figure 9:
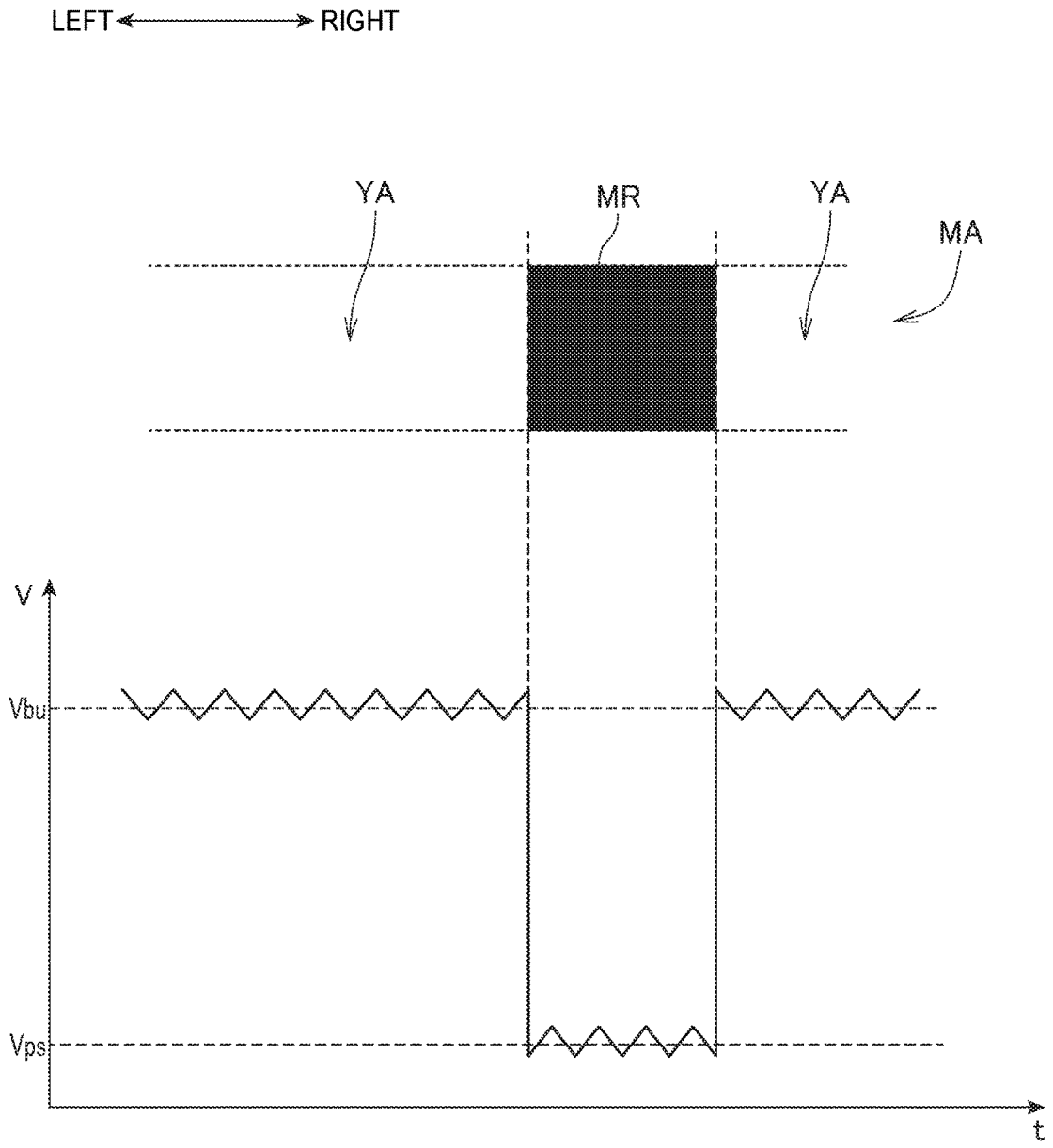
FIG. 9 describes mark detection.

FIG. 9 describes detecting a mark MR. The vertical axis in FIG. 9 shows voltage, and the horizontal axis shows time. The voltage on the vertical axis in FIG. 9 is the voltage corresponding to the amount of reflected light detected by the mark sensor 76.

In FIG. 9, the amount of reflected light from the mark MR is less than the amount of reflected light from the margin YA of the medium M. This is because white is the color that reflects the most amount of light. Also in FIG. 9, voltage Vbu is the voltage corresponding to the reference light level acquired in step SA29.

As also indicated by the arrows, in the description referring to FIG. 9 the direction to the left in FIG. 9 is referred to as left, and the direction to the right is referred to as right.

Furthermore, when the medium M is conveyed, the mark MR moves to the left with the medium M in FIG. 9, and the position on the medium M to which the mark sensor 76 projects light moves relatively to the right.

When a reference light level is acquired at time t1, the controller 100 conveys the medium M opposite the conveyance direction H by the conveyance mechanism 106 after time t1 while monitoring the amount of reflected light detected by the mark sensor 76. From time t1 to time t2 in FIG. 9, the voltage corresponding to the amount of reflected light is voltage Vbu because light is reflected from the margin YA on the left in the mark printing area MA. Note that the voltage referenced to voltage Vbu fluctuates from time t1 to time t2 because specific noise is superimposed when the mark sensor 76 detects the reflected light.

When the position of the light projected by the mark sensor 76 reaches the mark MR at time t2, the amount of reflected light detected by the mark sensor 76 changes, and the voltage corresponding to the amount of light detected by the mark sensor 76 goes to voltage Vps, which is lower than voltage Vb. From time t2, the controller 100 continues monitoring the amount of reflected light detected by the mark sensor 76 while conveying the medium M opposite the conveyance direction H by the conveyance mechanism 106.

At time t3, when the position to which the light projected by the mark sensor 76 moves away from the mark MR and enters the margin YA on the right side of the mark printing area MA, the amount of reflected light detected by the mark sensor 76 changes, and the voltage corresponding the amount of reflected light detected by the mark sensor 76 returns to voltage Vbu. Note that the voltage referenced to voltage Vps fluctuates from time t2 to time t3 because specific noise is superimposed when the mark sensor 76 detects the reflected light.

As shown in FIG. 9, if the voltage corresponding to the amount of reflected light detected goes below the voltage Vbu set in step SA29, and then returns to voltage Vbu, the controller 100 determines a mark MR was detected. Note that as shown in FIG. 9, noise is superimposed on the voltage corresponding to the detected light. As a result, considering this noise, the controller 100 determines a mark MR was detected if the voltage corresponding to the amount of reflected light detected goes to a voltage a specific multiple less than the voltage Vbu and then returns to voltage Vbu.

Referring again to the flow chart in FIG. 4, if the controller 100 determines in step SA31 that a mark MR was detected (step SA31: YES), the threshold controller 112 sets the threshold of the light the mark sensor 76 detects as a mark MR when light is projected at the white medium emittance level (step SA32). More specifically, the threshold controller 112, in step SA32, sets the median between the reference light level acquired in step SA29 and the amount of reflected light detected from the mark MR, as the threshold level of light the mark sensor 76 detects as a mark MR when emitting at the white medium emittance level. In other words, the threshold controller 112 sets as the threshold the median between the amount of reflected light detected in the margin YA of the medium M, and the amount of reflected light detected from the mark MR.

As a result, the controller 100 can accurately detect both edges TB of the mark MR, and can accurately detect the marks MR on the medium M when light is projected at the white medium emittance level. In addition, by setting the threshold in step SA32, the threshold controller 112 can prevent detecting as a mark MR any marks other than actual marks MR.

When the threshold at which the mark sensor 76 detects marks MR when light is projected at the white medium emittance level is set, the controller 100 detects marks MR while projecting light at the white medium emittance level, and indexes the medium M (step SA20).

As described above, because the controller 100 can accurately detect marks with the mark sensor 76, the controller 100 can appropriately index the medium M even when the medium M is a white medium. In addition, once the medium M is indexed, the controller 100 starts printing based on print data (step SA21).

As described above, in contrast to the non-white medium mode, in the white medium mode the controller 100 does not execute a process of detecting marks MR with light projected at the temporary emittance level. This is because the probability is high that marks MR printed on a white medium are a color other than white, and the probability is extremely high that the amount of light reflected by the mark MR will be less than the amount of light detected from the white medium. In other words, the amount of light reflected from a mark MR printed on a white medium will not exceed the detection range of the mark sensor 76. Therefore, in the white medium, a process of detecting marks MR with light emitted at the temporary emittance level is an unnecessary process.

Because the controller 100 is configured to not execute the process of detecting marks MR with light emitted at the temporary emittance level when in the white medium mode, the white medium emittance level can be quickly set, and the processing load preceding indexing the medium M can be reduced.

As described above, a printer 1 (printing device) according to the invention has a media type identifier 110 configured to identify the type of medium M (print medium); a mark sensor 76 (detection device) configured to project light and detect a mark MR on the medium M; and an emittance controller 111 configured to set the emittance level of light the mark sensor 76 projects.

The printer 1 can change the operating mode between a white medium mode (first mode) and a non-white medium mode (second mode) appropriately according to the type of medium M identified by the media type identifier 110.

In the white medium mode, the mark sensor 76 detects a mark MR with the emittance level set by the emittance controller 111 to the white medium emittance level (first emittance level).

In the non-white medium mode, the mark sensor 76 detects a mark MR with the emittance level set by the emittance controller 111 to the non-white medium emittance level (second emittance level).

Thus comprised, because the emittance controller 111 sets the white medium emittance level to detect marks MR when the operating mode corresponding to the type of medium M is the white medium mode, and sets the non-white medium emittance level to detect marks MR when the operating mode corresponding to the type of medium M is the non-white medium mode, light is projected at different emittance levels according to the type of the medium M, and marks MR on the medium M can be detected accurately according to the type of medium M.

The emittance controller 111, in the in the non-white medium mode, sets the emittance level of the mark sensor 76 to a temporary emittance level (third level), and based on a mark MR the mark sensor 76 detects with light projected at the temporary emittance level, sets the emittance level of the mark sensor 76 to a non-white medium emittance level.

Because this configuration sets the non-white medium emittance level based on a mark MR detected with light projected at the temporary emittance level, being unable to detect marks MR due to the type of color of the marks MR printed on a non-white medium can be reduced, and marks MR printed on a non-white medium can be accurately detected.

A printer 1 according to the invention preferably also has a threshold controller 112 configured to set a threshold for detecting marks MR. In the non-white medium mode, the threshold controller 112 sets the threshold based on a mark MR detected by the mark sensor 76 based on projected light.

Because this configuration sets the threshold based on a mark MR detected by projected light, detecting other than marks MR when light is projected at the white medium emittance level, non-white medium emittance level, or temporary emittance level can be prevented, and marks MR on a medium M can be accurately detected.

In the non-white medium mode, the threshold controller 112 sets as the threshold the median between the amount of light projected by the mark sensor 76 that is reflected by the medium M in an area not including a mark MR, and the amount of light that is reflected by a mark MR.

By setting as the threshold the median between the amount of light that is reflected by the medium M in an area not including a mark MR, and the amount of light that is reflected by a mark MR, this configuration enables accurately detecting both edges TB of the mark MR, and accurately detecting marks MR printed on the medium M.

A printer 1 according to the invention preferably also has a display 104 (reporting device). When the mark sensor 76 cannot detect a mark MR by light projected at the temporary emittance level, the display 104 reports information by displaying information indicating that a mark MR could not be detected (information indicating an error).

By reporting information indicating that a mark MR could not be detected when the mark sensor 76 cannot detect a mark MR by light projected at the temporary emittance level, this configuration enables the user to know that the printer 1 cannot detect marks MR printed on the medium M.

Further preferably, the printer 1 preferably also has a conveyance mechanism 106 configured to convey a medium M; and a printing position controller 113 configured to, when the mark sensor 76 cannot detect a mark MR with light projected at the temporary emittance level, project light by the mark sensor 76 at the temporary emittance level to the printing surface of the medium M while conveying the medium M by the conveyance mechanism 106, and determine a position at which to start printing based on an amount of light reflected from the printing surface of the medium M.

Because the position at which to start printing is determined based on an amount of light reflected from the printing surface of the medium M, this configuration can index the medium M even when marks MR on the medium M cannot be detected.

Further preferably, when the mark sensor 76 projects light at the temporary emittance level to the printing surface of the medium M, the conveyance mechanism 106 conveys the medium M at a conveyance speed that is slower than the conveyance speed when printing.

Because this configuration conveys the medium M at a conveyance speed that is slower than the conveyance speed when printing when light is projected at the temporary emittance level to the printing surface of the medium M, the printing position controller 113 can accurately acquire change in the reflection from the printing surface of the medium M, the medium M can be accurately indexed even when marks MR on the medium M cannot be detected.

Further preferably, the emittance controller 111 sets the white medium emittance level in the white medium mode based on the mark sensor 76 projecting light to a part of the medium M other than a mark MR.

Thus comprised, because in the white medium mode the white medium emittance level is set based on projection of light to a part of the medium M other than a mark MR, the white medium emittance level can be set quickly without executing a process projecting light at the temporary emittance level, and the processing load required to set the emittance level can be reduced. This is also related to reducing the processing load of the processes required to index the medium M. Furthermore, because the white medium emittance level is set in the white medium mode not based on the amount of light reflected from a mark MR, the process of detecting a mark MR can be omitted, and the white medium emittance level can be quickly set.

In another aspect of the invention, the mark sensor 76 projects light to a margin YA of the medium M, and the media type identifier 110, based on the amount of light projected to the margin YA of the medium M that is reflected, determines the type of medium M.

Thus comprised, because the type of medium M can be identified based on the amount of projected light that is reflected from the margin YA of the medium M, the type of medium M can be accurately detected using a margin YA where nothing is printed.

In the invention, a medium M that is processed in the white medium mode is a white medium, and a medium M that is processed in the non-white medium mode is a non-white medium.

Thus comprised, because the mark sensor 76 projects light at different emittance levels according to whether the type of medium M is a white medium or a non-white medium, marks MR on the medium M can be accurately detected whether the medium M is a white medium or a non-white medium.

The embodiments described above are examples of the present invention, and can be changed and modified in many ways without departing from the scope of the accompanying claims.

For example, in the embodiment described above the inkjet heads 51 and inkjet head 52 are inkjet line heads, but may be serial heads carried on a carriage. The ink ejected by the inkjet heads 51 and inkjet head 52 is also not limited to UV ink.

Furthermore, in the embodiment described above, a medium M that is white is referred to as a white medium, and a medium that is a color other than white is referred to as a non-white medium, but a white medium is not limited to a medium M that is a color white, and may be a medium having greater reflectance than white (such as a medium with a metallic shine), and may be a medium M in which the reflectance of the mark MR is less than the medium M. In this case, the same effects described above can be achieved. Note that a non-white medium may be a colored, transparent, or translucent medium M if the reflectance of marks MR is greater than the reflectance of the medium M.

Furthermore, in the embodiments described above, the trigger that starts operation of the printer 1 is described as the start of printing, but the trigger is not so limited. For example, the trigger that starts operation of the printer 1 may be the printer 1 power turning on, or receiving print data from a host computer not shown in the figures.

When the control method of the printer 1 described above (control method of a printing device) is executed by a computer of the printer 1, the invention can also be embodied by a program executed by a computer to implement the foregoing control method, a storage medium recording the program readably by the computer, or a communication medium able to transfer the program. The recording medium may also be a magnetic or optical recording medium, or a semiconductor memory device, for example. More specifically, the recording medium may be a floppy disk, HDD (Hard Disk Drive), CD-ROM (Compact Disk Read Only Memory), DVD (Digital Versatile Disk), Blu-Ray® Disc, magneto-optical disc, flash memory device, card media, or other type of removable or fixed recording medium. The recording medium may also be an internal storage device of the printer 1, such as ROM (read-only memory), hard disk drive, or other nonvolatile storage device.

The processing units shown in FIG. 4 and FIG. 5, for example, are also used to facilitate understanding the process of the printer 1, are divided according to the main content of the process, and the invention is not limited by the method of dividing and naming the process units. The process of the printer 1 may be further divided into more steps according to the process content. Individual steps may also be further divided into more steps.

The function units shown in FIG. 2 illustrate desirable functional configurations, and the specific configuration of the invention is not limited thereto. More specifically, hardware components corresponding individually to each function unit are not necessarily required, and configurations in which a single processor embodies the functions of multiple function units by executing a specific program or programs are obviously conceivable. Furthermore, some functions embodied by software in the embodiments may be embodied by hardware, and some functions embodied by hardware in the embodiments may be embodied by software. The specific detailed configurations of the printer 1 and other parts can also be varied as desired without departing from the scope of the invention.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-096411, filed May 15, 2017 is expressly incorporated by reference herein.

What is claimed is:

1. A printing device comprising:

a media type identifier configured to identify a type of a print medium;

a conveyance mechanism configured to convey the print medium;

a detection device configured to project light and detect a mark on the print medium;

an emittance controller configured to set an emittance level of light the detection device projects;

the printing device changing an operating mode according to the type of print medium identified by the media type identifier to a first mode used to process a print medium having greater reflectance of light than the mark, or a second mode used to process a print medium having less reflectance of light than the mark;

the detection device detecting a mark with the emittance level set by the emittance controller to a first level in the first mode, and detecting a mark with the emittance level set by the emittance controller in the second mode to a second level, which is higher than the first level, the emittance controller, in the second mode, also being configured to set the emittance level of the detection device to a third level, and based on a mark the detection device detects with light projected at the third level, sets the emittance level of the detection device to the second level; and a printing position controller configured to, when the detection device cannot detect the third mark with light projected at the third level, project light by the detection device at the third level to the printing surface of the print medium while conveying the print medium by the conveyance mechanism, and determine a position at which to start printing based on an amount of light reflected from the printing surface of the print medium, wherein, the conveyance mechanism, when the detection device projects light at the third level to the printing surface of the print medium, conveys the print medium at a conveyance speed that is slower than the conveyance speed when printing.

2. The printing device described in claim 1, further comprising:

a threshold controller configured to set a threshold the detection device uses to detect the mark;

the threshold controller, in the second mode, setting the threshold based on the mark the detection device detected by projecting light.

3. The printing device described in claim 2, wherein:

the threshold controller sets, as the threshold, a median between an amount of light projected by the detection device that is reflected by the print medium outside the mark, and the amount of light that is reflected by the mark.

4. The printing device described in claim 1, further comprising:

a reporting device configured to report information;

the reporting device reporting information indicating an error when the detection device cannot detect the mark by light projected at the third level.

5. The printing device described in claim 1, wherein:

the emittance controller sets the first level in the first mode based on the detection device projecting light to a part of the print medium other than the mark.

6. The printing device described in claim 1, wherein:

the detection device projects light to a margin of the print medium, and the media type identifier, based on the amount of light projected to the margin of the print medium that is reflected, determines the type of print medium.

7. The printing device described in claim 1, wherein:

the print medium that is processed in the first mode is a print medium that is white, and a print medium that is processed in the second mode is a print medium of a color other than white.

8. A control method of a printing device comprising:

identifying a type of a print medium by a media type identifier and a detection device that is configured to project light and detect a mark on the print medium conveyed by a conveying mechanism;

changing an operating mode according to the type of print medium identified to a first mode used to process a print medium having greater reflectance of light than the mark on the print medium, or a second mode used to process a print medium having less reflectance of light than the mark;

in the first mode, detecting a mark with the emittance level of projected light set to a first level by an emittance controller configured to set an emittance level of the light the detection device projects, and in the second mode, detecting a mark with the emittance level set to a second level, which is higher than the first level, wherein, the emittance controller, in the second mode, also is configured to set the emittance level of the detection device to a third level, and based on a mark the detection device detects with light projected at the third level, sets the emittance level of the detection device to the second level;

when the detection device cannot detect the mark with light projected at the third level, project light by the detection device at the third level to the printing surface of the print medium by a printing position controller while conveying the print medium by the conveyance mechanism, and determine a position at which to start printing based on an amount of light reflected from the printing surface of the print medium, and wherein, the conveyance mechanism, when the detection device projects light at the third level to the printing surface of the print medium, conveys the print medium at a conveyance speed that is slower than the conveyance speed when printing.

9. A printing device comprising:

a media type identifier configured to identify a type of a print medium;

a detection device configured to project light to an unprintable area of the print medium and detect a reflectance of light from the unprintable area; and an emittance controller configured to set an emittance level of light the detection device projects;

the printing device changing an operating mode according to the type of print medium identified by the media type identifier, based on the reflectance of light from the unprintable area, to a first mode used to process the print medium if it has a greater reflectance of light than a mark on the print medium, or a second mode used to process the print medium if it has a lesser reflectance of light than the mark;

the detection device configured to project light to the mark and detect a mark with the emittance level set by the emittance controller to a first level in the first mode, and detect a mark with the emittance level set by the emittance controller in the second mode to a second level, which is higher than the first level.

* * * * *